US008210369B2

(12) United States Patent
Hibshman

(10) Patent No.: US 8,210,369 B2
(45) Date of Patent: Jul. 3, 2012

(54) SPLICE STRUCTURE FOR ALIGNING TWO PORTIONS OF A DRAPERY TRACK

(75) Inventor: Joel E. Hibshman, Whitehall, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 554 days.

(21) Appl. No.: 12/400,219

(22) Filed: Mar. 9, 2009

(65) Prior Publication Data

US 2010/0224332 A1 Sep. 9, 2010

(51) Int. Cl.
*A47H 1/02* (2006.01)

(52) U.S. Cl. ..... 211/105.1

(58) Field of Classification Search .... 211/105.1–105.6, 211/123; 248/343, 317, 265; 160/39, 330; 16/96 R, 94 R
See application file for complete search history.

(56) References Cited

U.S. PATENT DOCUMENTS

| | | | | | |
|---|---|---|---|---|---|
| 839,153 | A | * | 12/1906 | Kinnaman | 52/581 |
| 1,304,678 | A | * | 5/1919 | Goodrow | 160/39 |
| 1,611,003 | A | * | 12/1926 | Dearwester | 40/799 |
| 1,625,160 | A | * | 4/1927 | Robinson | 248/263 |
| 1,684,843 | A | * | 9/1928 | Newmark | 160/39 |
| 1,945,356 | A | * | 1/1934 | Naftzger | 160/39 |
| 2,247,954 | A | * | 7/1941 | Levaggi | 160/39 |
| 2,332,207 | A | * | 10/1943 | Derman | 160/39 |
| 2,530,593 | A | * | 11/1950 | Bashwiner | 160/39 |
| 2,563,734 | A | * | 8/1951 | Metz et al. | 160/21 |
| 2,590,555 | A | * | 3/1952 | Malchiodi | 160/39 |
| 2,636,557 | A | * | 4/1953 | Williams | 160/39 |
| 2,914,286 | A | * | 11/1959 | Weaver | 248/265 |
| 3,077,923 | A | * | 2/1963 | Hatcher | 160/38 |
| 3,378,057 | A | * | 4/1968 | Synck | 160/39 |
| 3,567,261 | A | * | 3/1971 | Akczinski | 403/106 |
| 3,975,792 | A | | 8/1976 | Janson | |

(Continued)

OTHER PUBLICATIONS

BTX Window Automation Inc., Installation Instructions for 5060 Sofia Motorized Drapery System, 2005, 12 pages.
BTX Window Automation Inc., Installation Instructions for Shading System 5066, 2005, 12 pages.
Lutron Electronics Co., Inc., Sivoia QED D105 Drapery Track System Specification Submittal Sheets, Sep. 2, 2008, 21 pages.
Description of Prior Art Splicing Means that Shipped with Lutron Sivoia QED Drapery Systems at Least as Early as Jun. 2006, 5 pages.

*Primary Examiner* — Jennifer E. Novosad
(74) *Attorney, Agent, or Firm* — Mark E. Rose; Philip N. Smith; Bridget L. McDonough

(57) ABSTRACT

A drapery system comprises an elongated track having two track portions and an elongated rectangular splice structure for coupling the two track portions together. Each track portion has a splice channel and at least one track hole located in the splice channel. The splice structure has at least two splice holes extending through the splice structure and is adapted to be received within the splice channels. Screws are received through the splice holes and extend into the track holes in a direction perpendicular to the splice structure. The distance between the two splice holes is less than the distance between the two track holes when the two track portions are aligned adjacent each other and the screws are not installed. Each of the screws contacts an edge of the respective track hole to provide a longitudinal force on the respective track portion when the screws are installed in the splice holes and track holes, such that the track portions are forced together.

16 Claims, 7 Drawing Sheets

U.S. PATENT DOCUMENTS 4,068,346 A * 1/1978 Binder ..... 16/110.1
4,359,079 A * 11/1982 Bledsoe ..... 160/26
4,363,459 A * 12/1982 Holzer ..... 248/265
4,662,421 A * 5/1987 Basmadji et al. ..... 160/38
4,967,991 A * 11/1990 Simon ..... 248/265
5,112,157 A * 5/1992 Haarer ..... 403/292
5,330,821 A * 7/1994 Lo ..... 428/120
5,765,619 A * 6/1998 Arnold ..... 160/84.07
6,935,403 B2 8/2005 Killo et al.
6,994,145 B2 2/2006 Killo et al.
2006/0027335 A1 * 2/2006 Nien et al. ..... 160/39
2009/0151126 A1 * 6/2009 Welsch et al. ..... 16/96 R

* cited by examiner

SPLICE STRUCTURE FOR ALIGNING TWO PORTIONS OF A DRAPERY TRACK

BACKGROUND OF THE INVENTION

1. Field of the Invention

The present invention relates to a drapery system for moving a suspended drapery fabric, and more particularly, to a splice structure for coupling together and aligning two portions of a drapery track.

2. Description of the Related Art

Motorized drapery systems allow for movement of a suspended drapery fabric covering, for example, a window or other opening. Typical motorized drapery systems include a drive system having a reversible motor that turns a drive pulley for moving a drive belt within an elongated track. The drive belt is connected to a master car to provide for movement of the master car in two opposite directions depending on the direction that the reversible motor is driving the drive belt. The drapery fabric is attached to the master car and a plurality of auxiliary cars that do not engage the drive belt. The master car and auxiliary cars include wheels received within the track to provide rolling movement of the cars. An elongated slot is provided in the track for connection between the cars positioned within the track and suspended drapery fabric.

Since some drapery tracks of drapery systems can be rather long (e.g., exceeding 15 feet in length), drapery systems of this length are not typically shipped from a manufacturer to a customer pre-assembled (i.e., as a single piece). There exists a need for a drapery system having a drapery track that may be shipped to a customer as several sections and then easily installed together in a way that provides for reliable operation and movement of the master car and auxiliary cars along the length of the drapery track.

SUMMARY OF THE INVENTION

According to an embodiment of the present invention, a drapery system for allowing the movement of a suspended drapery fabric comprises an elongated track having two track portions and an elongated rectangular splice structure for coupling the two track portions together. Each of the track portions extends along a longitudinal axis of the track and has a splice channel and at least one circular track hole located in the splice channel. The splice structure has at least two circular splice holes extending through the splice structure. The splice structure is received within the splice channels of each of the track portions, such that the center of each splice hole is offset from the center of the respective track hole by a distance that is less than half of the radius of the track hole. At least two screws are received through the splice holes and extend into the track holes in a direction perpendicular to the splice structure. The distance between the centers of the two splice holes is less than the distance between the centers of the two track holes when the two track portions are aligned adjacent each other and the screws are not installed. Each of the screws contacts an edge of the respective track hole to provide a longitudinal force on the respective track portion when the screws are installed in the splice holes and track holes, such that the track portions are forced together.

According to another embodiment of the present invention, a drapery system for allowing the movement of a suspended drapery fabric comprises an elongated track having two track portions extending along a longitudinal axis of the track, an elongated rectangular splice structure, and four screws. Each of the track portions has a splice channel and two track holes, which are located in the splice channel and are arranged along a centerline of the track portion parallel to the longitudinal axis. The splice structure has four splice holes that extend through the splice structure and are arranged along a centerline of the splice parallel to the longitudinal axis. The splice structure is received within the splice channels of each of the track portions, such that the center of each splice hole is offset from the center of the respective track hole by a distance that is less than half of the radius of the track hole. The four screws are received through the splice holes and extend into the track holes in a direction perpendicular to the splice structure. The four screws provide transverse alignment of the track portions to prevent rotation of the splice structure about a yaw axis of the splice when the screws are installed in the respective splice holes and track holes. The distance between the two splice holes is less than the distance between the two track holes when the two track portions are aligned adjacent each other and the screws are not installed. Each of the screws is adapted to contact an edge of the respective track hole to provide a longitudinal force on the respective track portion, such that the track portions are forced together when the screws are installed in the splice holes and track holes.

In addition, a method of installing a drapery track of a drapery system that allows for the movement of a suspended drapery fabric is also described herein. The method comprises the steps of: (1) providing two track portions of the drapery track, each of the track portions having a splice channel and a track hole located in the splice channel; (2) inserting an elongated rectangular splice structure into the splice channels of each of the track portions, such that the track portions are aligned adjacent each other along a longitudinal axis of the drapery track; (3) providing two splice holes extending through the splice structure, the center of each splice hole offset from the center of the respective track hole by a distance that is less than half of the radius of the track hole when the splice structure is installed in the splice channels of each of the track portions, such that the distance between the two splice holes is less than the distance between the two track holes; (4) driving two screws through the splice holes and into the track holes, respectively, in a direction perpendicular to the splice structure; and (5) forcing the track portions together by causing each of the screws to contact an edge of the respective track hole to provide a longitudinal force on the respective track portion.

Other features and advantages of the present invention will become apparent from the following description of the invention that refers to the accompanying drawings.

BRIEF DESCRIPTION OF THE DRAWINGS

For the purpose of illustrating the invention, there is shown in the drawings a form, which is presently preferred, it being understood, however, that the invention is not limited to the precise arrangements and instrumentalities shown. The features and advantages of the present invention will become apparent from the following description of the invention that refers to the accompanying drawings, in which.

DETAILED DESCRIPTION OF THE INVENTION

Figure 1:
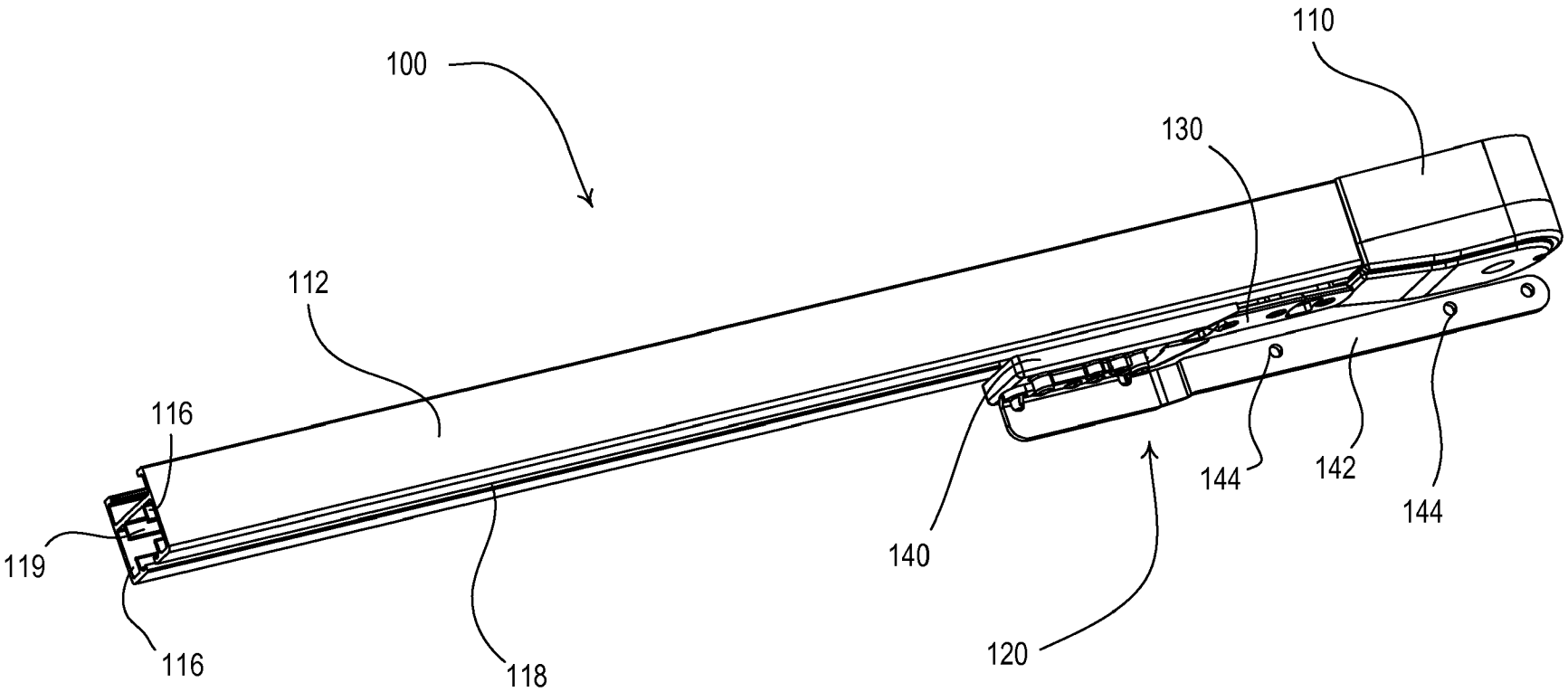
FIG. 1 is a perspective view of a motorized drapery system for suspending a drapery fabric.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a perspective view of a portion of a motorized drapery system 100 for movement of a suspended drapery fabric (not shown) for covering an opening (such as, for example, a window). The drapery system 100 operates to move the drapery fabric between a fully open position (in which the window is not covered by the drapery fabric) and a fully closed position (in which the window is completely covered by the drapery fabric). The drapery system 100 includes an idler end 110 at a first end of a track 112. While not shown in FIG. 1, the track 112 extends further away from the idler end 110 (i.e., to the left as shown in FIG. 1) for the length of the window or other opening that the drapery fabric is covering. A drive end (not shown) is provided at the second end of the track 112 and is adapted to be coupled to a reversible motor (not shown). A drive belt (not shown) extends through the drive end, the idler end 110, and belt channels 116 of the track 112 and is driven by the motor through a drive pulley (not shown) in the drive end.

The drapery system 100 comprises a master car 120 having a driven portion 130 and a non-driven portion 140. The non-driven portion 140 includes a drapery attachment bar 142 to allow for attachment to the suspended drapery fabric via openings 144. The master car 120 extends through an elongated slot 118 and is operable to travel through a drapery car channel 119 of the track 112. The drapery system 100 also comprises a plurality of auxiliary cars (not shown) that also travel through the drapery car channel 119 and extend through the elongated slot 118 to connect to the drapery fabric. The driven portion 130 of the master car 120 is coupled to the drive belt, such that the master car and the auxiliary cars are operable to move in response to the movements of the belt. The drive system (including the drive end of the track 112, the motor, and the drive pulley) and the auxiliary cars are shown and described in greater detail in U.S. Pat. No. 6,935,403, issued Aug. 30, 2005, and U.S. Pat. No. 6,994,145, issued Feb. 7, 2006, both entitled MOTORIZED DRAPERY PULL SYSTEM. The entire disclosures of both patents are hereby incorporated by reference.

Figure 2:
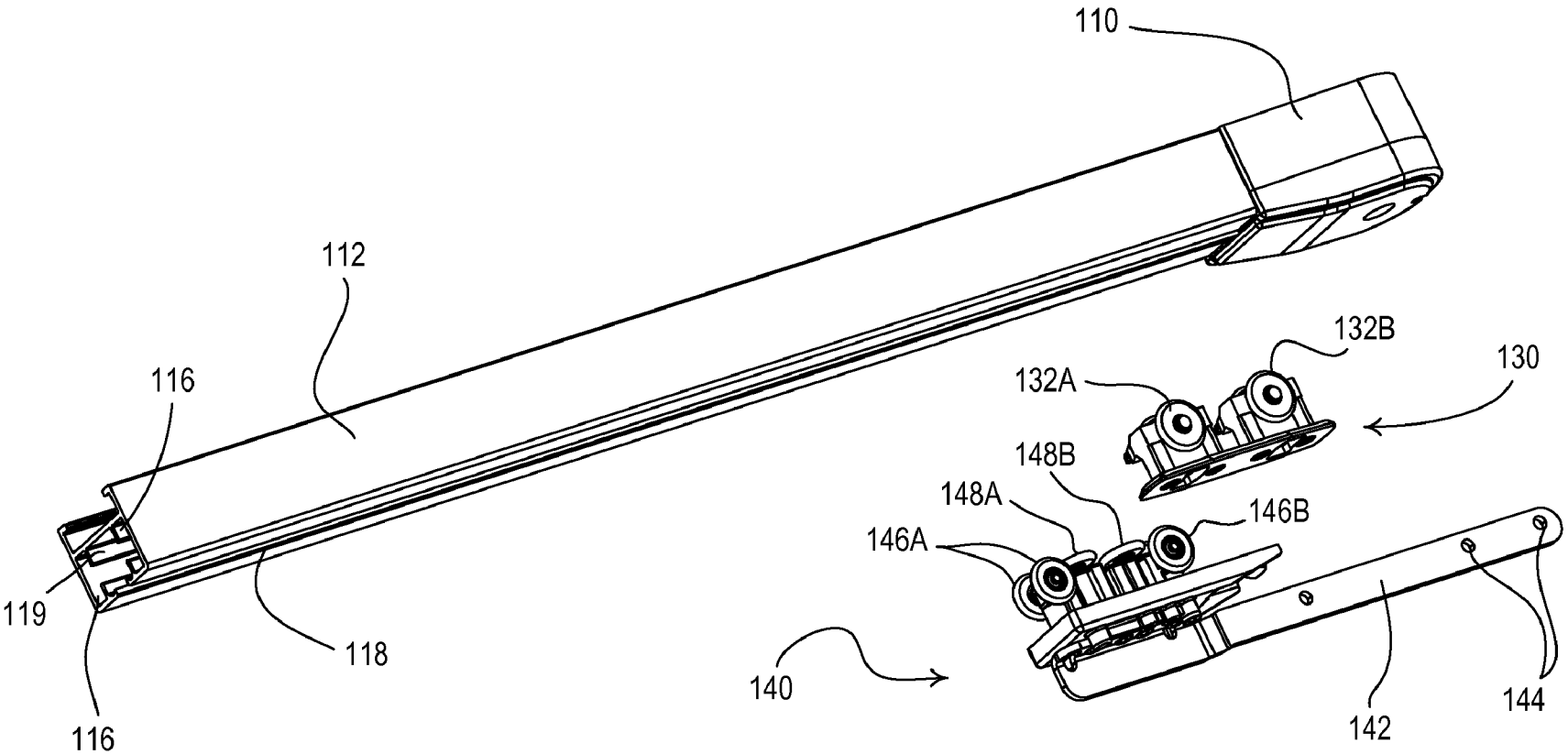
FIG. 2 is an exploded view of the motorized drapery system of FIG. 1.

FIG. 2 is an exploded view of the motorized drapery system 100 showing the driven portion 130 and the non-driven portion 140 of the master car 120 in greater detail. The driven portion 130 of the master car 120 comprises two pairs of vertically-oriented wheels 132A, 132B, while the non-driven portion 140 of the master car 120 comprises two pairs of vertically-oriented wheels 146A, 146B and two horizontally-oriented wheels 148A, 148B. The wheels 132A-148B of the driven and non-driven portions 130, 140 are adapted to roll through the drapery car channel 119 of the track 112. The driven portion 130 and the non-driven portion 140 are adapted to be coupled (e.g., snapped) together. When the driven and non-driven portions 130, 140 are coupled together, a user is operable to grasp the drapery fabric, which is attached to the drapery attachment bar 142 of the non-driven portion 140, and pull the non-driven portion away from the driven portion 130 to thus decouple the driven and non-driven portions 130, 140. The user is then able to manually move the drapery fabric along the length of the track 112 (e.g., by gripping and pulling the drapery fabric). When decoupled, the driven and non-driven portions 130, 140 may be coupled back together in response to the drive system moving the drive belt until the driven portion contacts the non-driven portion and the driven and non-driven portions snap back together.

Figure 3:
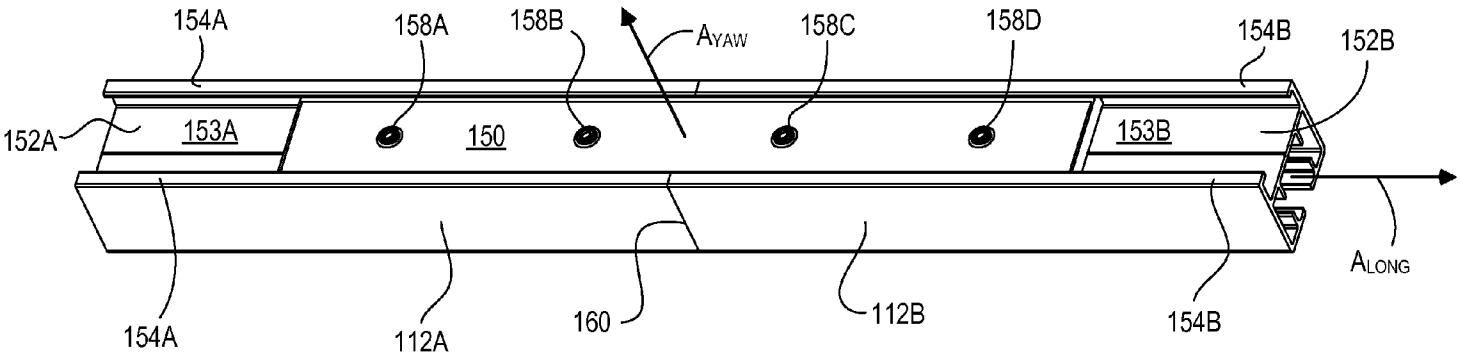
FIG. 3 is a perspective view of first and second track portions of a drapery track of the drapery system of FIG. 1 coupled together by a splice structure according to a first embodiment of the present invention.
Figure 4:
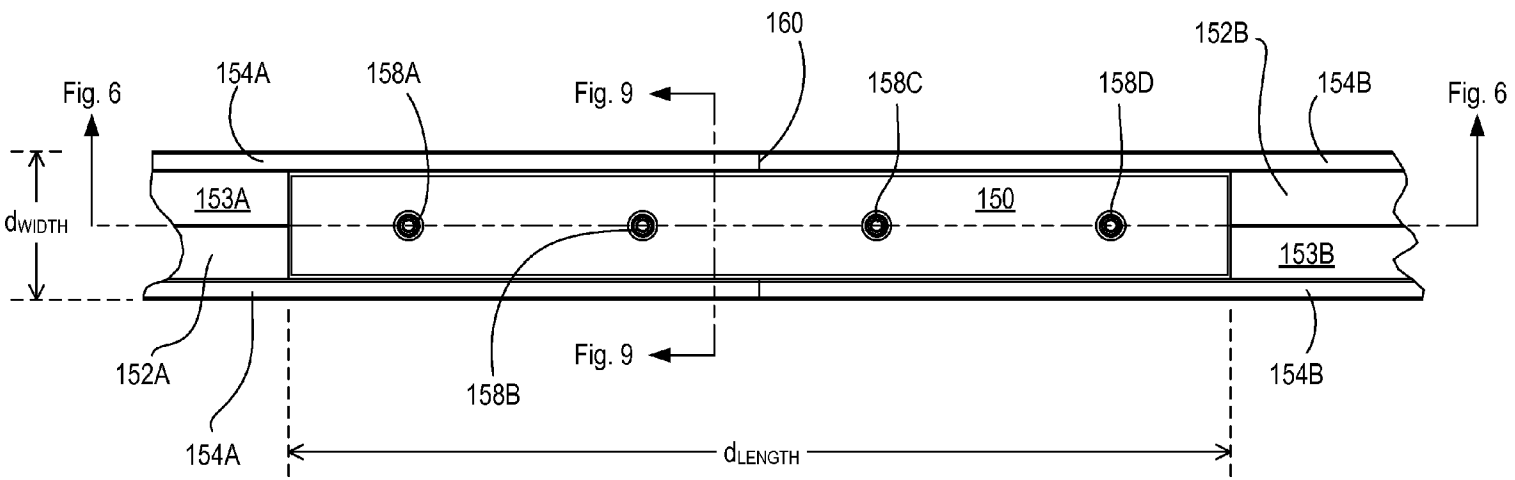
FIG. 4 is a top view of the first and second track portions of the drapery track of FIG. 3 coupled together by the splice structure according to the first embodiment of the present invention.

FIG. 3 is a perspective view and FIG. 4 is a top view of a first track portion 112A (e.g., connected to the drive end) and a second track portion 112B (e.g., connected to the idler end 110) coupled together by an elongated rectangular splice structure 150 according to a first embodiment of the present invention. The two track portions 112A, 112B meet at a seam 160 and are aligned adjacent each other along a longitudinal axis $A_{LONG}$ of the track 112. The splice structure 150 is received within splice channels 152A, 152B of the track portions 112A, 112B, such that the track portions both extend along a longitudinal axis of the track 112. For example, the splice structure 150 may have a length $d_{LENGTH}$ of approximately 8.0 inches and the track 112 may have a width $d_{WIDTH}$ of approximately 1.27 inches as shown in FIG. 4. The splice channels 152A, 152B each have an open side opposite a respective bottom surface 153A, 153B. The two opposing flanges 154A, 154B surround the open side of the splice channels 152A, 152B (thus, defining an opening between the two opposing flanges). The flanges 154A, 154B hold the splice structure 150 within the splice channels 152A, 152B, such that the splice structure is completely contained within the periphery of the track 112.

Figure 5:
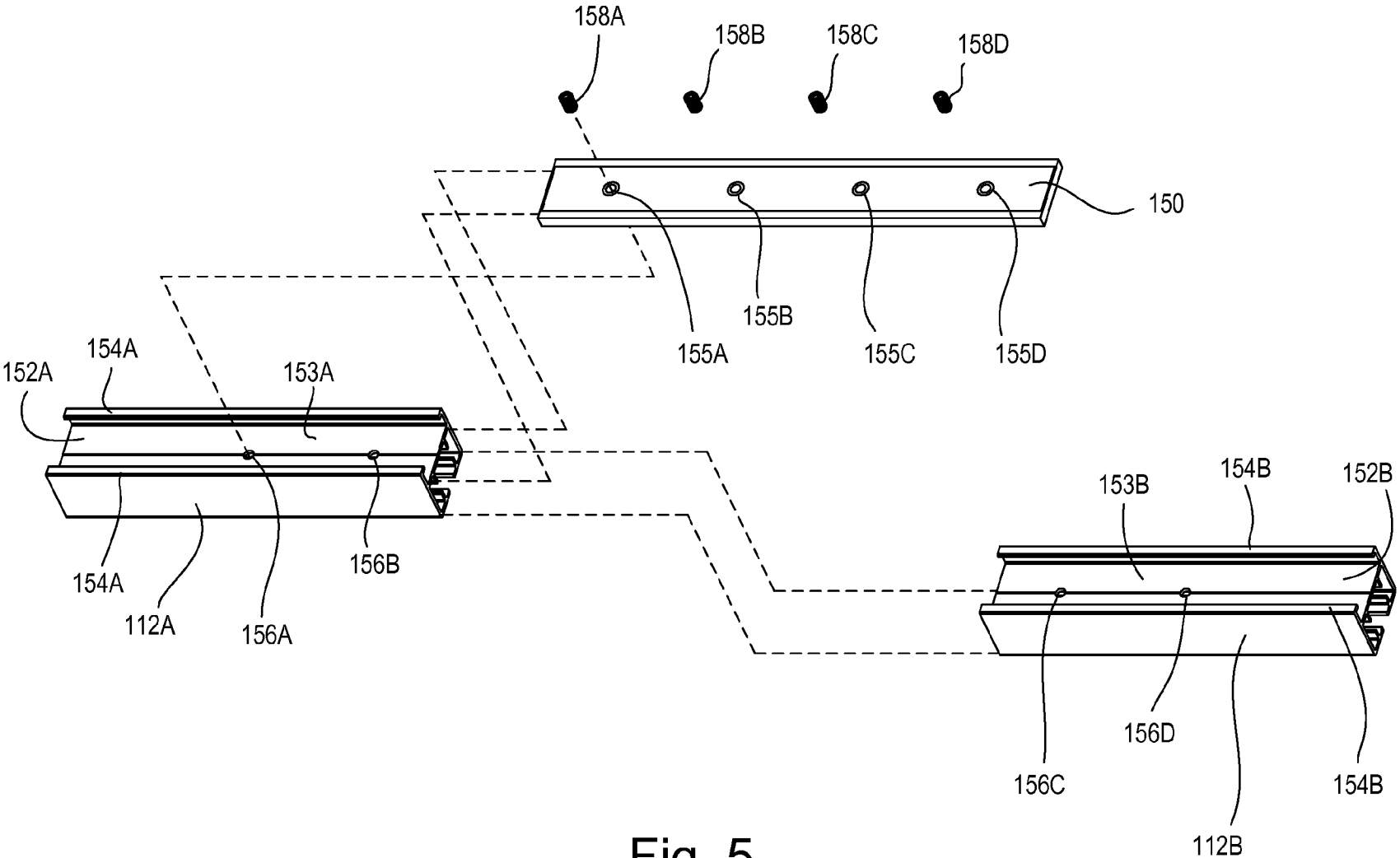
FIG. 5 is an unassembled perspective view of the first and second track portions of the drapery track of FIG. 3 showing how the splice structure is received within splice channels of the track portions.

FIG. 5 is an unassembled perspective view of the first and second track portions 112A, 112B showing how the splice structure 150 is received within the splice channels 152A, 152B. The splice structure 150 includes four splice holes 155A-155D, which are aligned along a centerline of the splice structure and extend through the splice structure. The four splice holes 155A-155D include two inwardly-positioned splice holes 155B, 155C and two outwardly-positioned splice holes 155A, 155D. The first and second track portions 112A, 112B have corresponding track holes 156A-156D, which include two inwardly-positioned track holes 156B, 156C located closest to the seam 160 and two outwardly-positioned track holes 156A, 156D located farthest from the seam. When the splice structure 150 is inserted into the splice channel 152A, 152B of each of the track portions 112A, 112B, the splice holes 155A-155D are accessible to a user in the opening provided between the flanges 154A, 154B of the track portions 112A, 112B.

To attach the two track portions 112A, 112B together, a plurality of screws 158A-158D (e.g., four screws) are received within the splice holes 155A-155D and the corresponding track holes 156A-156D, respectively. For example, each of the screws 158A-158B may comprise a #10×32 threaded screw having a length of 0.375 inch and a 90 degree cone point. The splice holes 155A-155D may each be threaded and may be tapped to, for example, 10-32 specifications to allow for receipt of the screws 158A-158D. The track holes 156A-156D may each have a diameter of approximately 0.156 inch.

Figure 6:
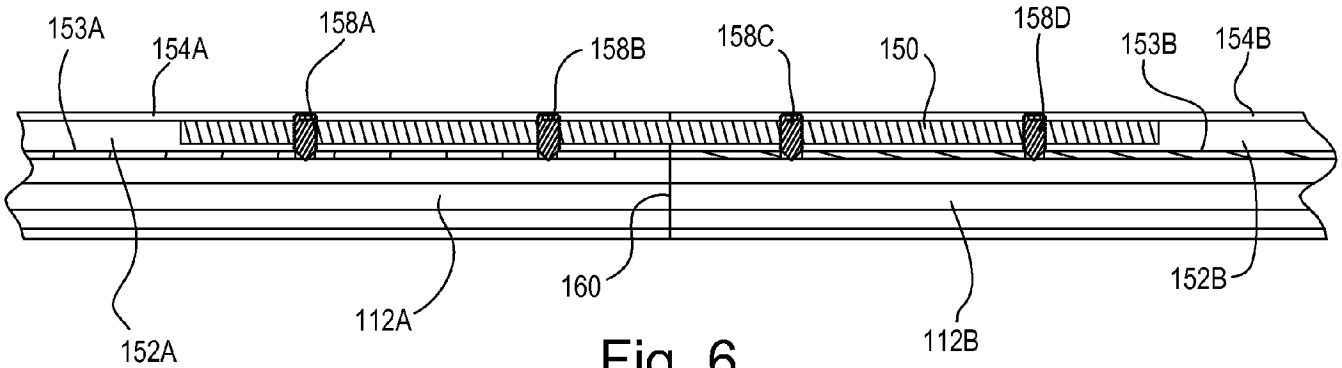
FIG. 6 is a front cross-sectional view of the connected first and second track portions of the drapery track of FIG. 3 with screws installed through the splice structure.

FIG. 6 is a front cross-sectional view of the connected first and second track portions 112A, 112B taken through the centerline of the track 112 as shown in FIG. 4 with the screws 158A-158D installed. The screws 158A-158D are driven into the splice holes 155A-155D and the respective track holes 156A-156D in a direction perpendicular to the splice structure 150. Thus, the screws 158A-158D extend through the splice holes 155A-155D and into the track holes 156A-156D and the splice structure 150 couples the two track portions 112A, 112B together. When the screws 158A-158D are installed, the screws apply a longitudinal force on the track portions 112A, 112B to urge the two track portions together at the seam 160.

Figure 7:
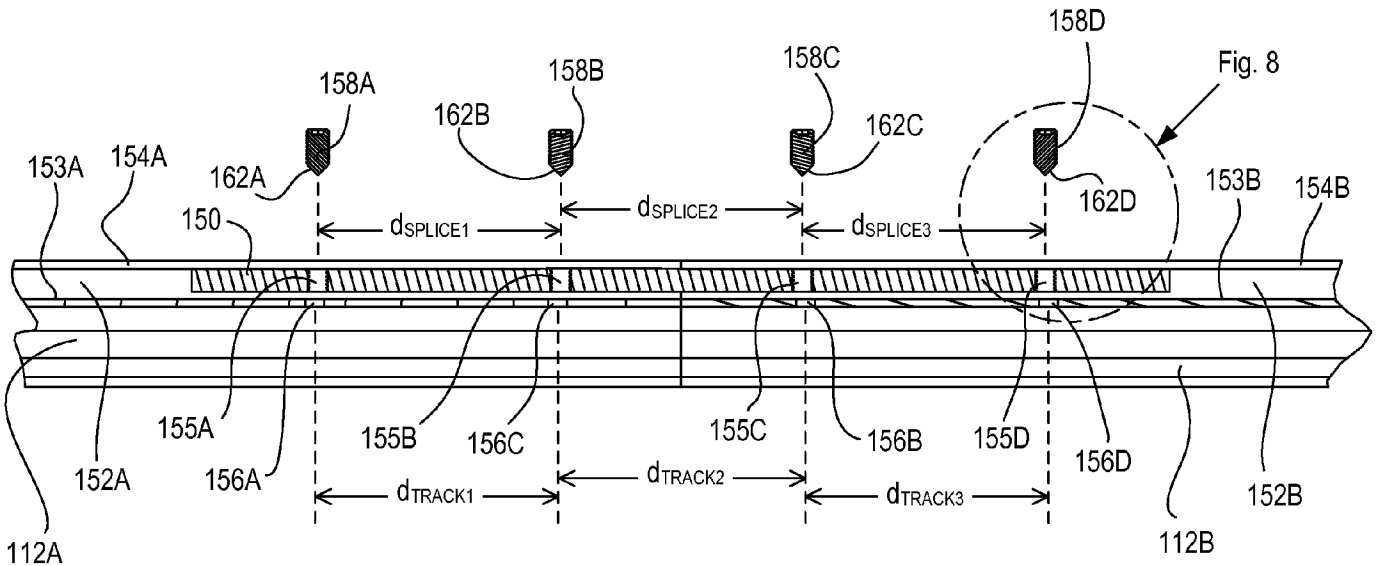
FIG. 7 is a front cross-sectional view of the connected first and second track portions of the drapery track of FIG. 3 without the screws installed.

FIG. 7 is a front cross-sectional view of the connected first and second track portions 112A, 112B taken through the centerline of the track 112 as shown in FIG. 4 without the screws 158A-158D installed. The distance $d_{SPLICE1}$ between the first and second splice holes 155A, 155B and the distance $d_{TRACK1}$ between the first and second track holes 156A, 156B are equal to each other and may be, for example, approximately 2.0 inches. Similarly, the distance $d_{SPLICE3}$ between the third and fourth splice holes 155C, 155D and the distance $d_{TRACK3}$ between the third and approximately fourth track holes 156C, 156D are also equal to each other and may also be approximately 2.0 inches. However, the distance $d_{SPLICE2}$ between the second and third splice holes 155B, 155C (i.e., the inwardly-positioned splice holes) is less than the distance $d_{TRACK2}$ between the second and third track holes 156B, 156C (i.e., the inwardly-positioned track holes). For example, the distance $d_{SPLICE2}$ may be approximately 2.0 inches, while the distance $d_{TRACK2}$ may be approximately 2.050 inches. The distances between any two adjacent splice holes 155A-155D of the splice structure 150 (i.e., $d_{SPLICE1}$, $d_{SPLICE2}$, $d_{SPLICE3}$) are all equal. Further, when the screws 158A-158D are not installed, the distance $d_{TRACK2}$ between the inwardly-positioned track holes 156B, 156C is greater than both of the distances $d_{TRACK1}$, $d_{TRACK3}$ between the outwardly-positioned track holes 156A, 156D and the adjacent inwardly-positioned track holes 156B, 156C.

Figure 8:
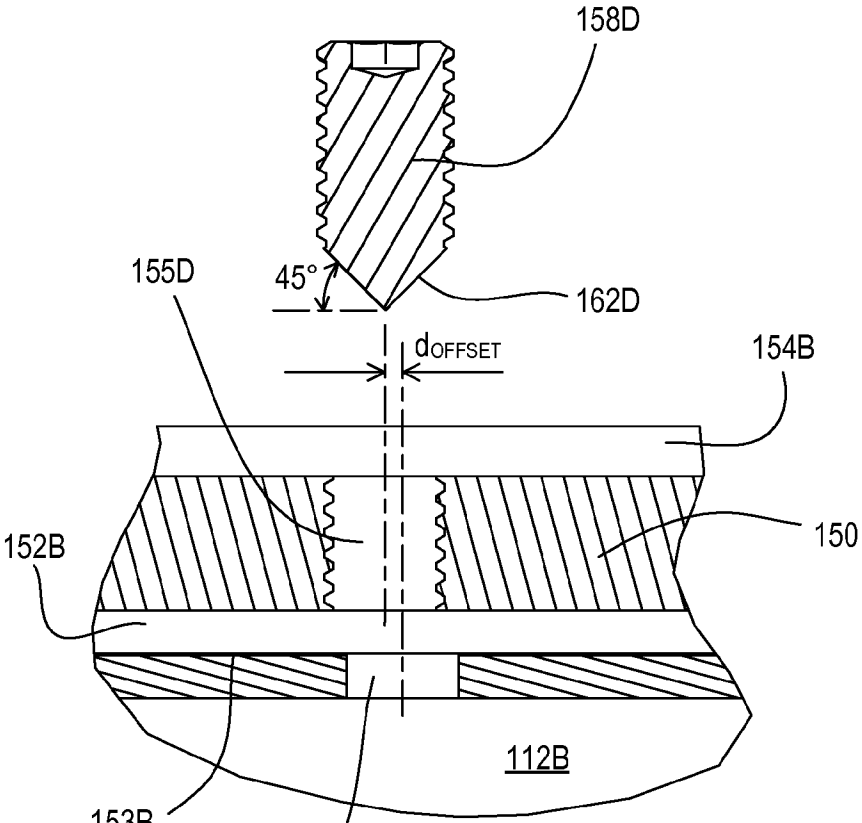
FIG. 8 is an enlarged front cross-sectional detail of a splice hole of the splice structure, a track hole of the drapery track, and one of the screws of FIG. 6 without the screw installed in the splice hole and the track hole.

FIG. 8 is an enlarged front cross-sectional detail of the splice hole 155D, the track hole 156D, and the screw 158D without the screw installed. The center of the splice hole 155D is not coincident with the center of the track hole 156D when the screws 158A-158D are not installed as shown in FIG. 8. Specifically, there may be an offset distance $d_{OFFSET}$ between the centers of the splice holes 155A-155D and the track holes 156A-156D. The offset distance $d_{OFFSET}$ is less than the radius of the respective track hole 156A-156D and may be, for example, approximately 0.025 inch. Each of the screws 158A-158D has a conical base portion 162A-162D, which contacts the edges of the respective track hole 156A-156D to force the track portions 112A, 112B together. As the screws 158A-158D are driven in a direction perpendicular to the splice structure 150, each of the conical base portions 162A-162D is arranged at angle of approximately 45 degrees with respect to the longitudinal axis $A_{LONG}$ of the track 112. Accordingly, each of the conical base portions 162A-162D contacts the edges of the respective track holes 156A-156D and applies a force on the splice structure 150 in the longitudinal direction (i.e., parallel to the longitudinal axis $A_{LONG}$ of the splice structure) to urge the two track portions 112A, 112B together.

Figure 9:
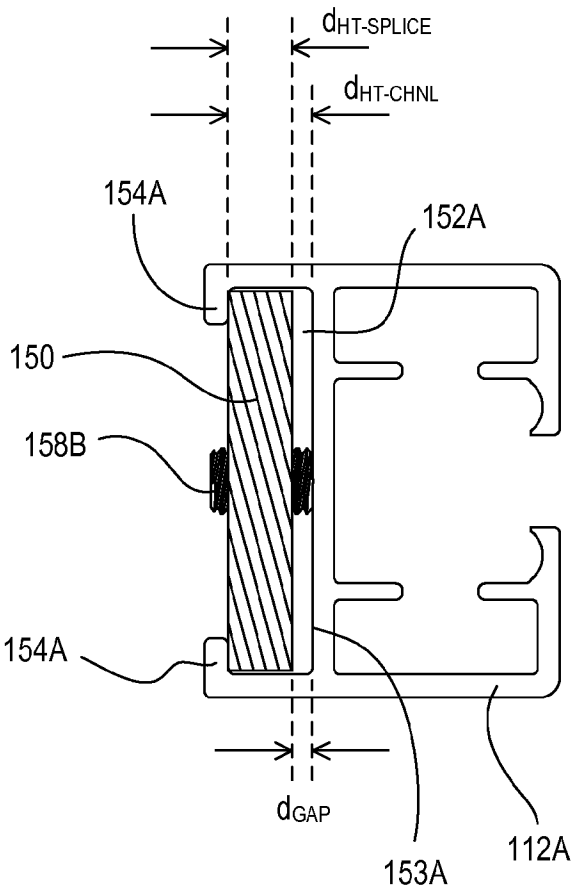
FIG. 9 is a right-side cross-sectional view of the first track portion of the drapery track of FIG. 3.

FIG. 9 is a right-side cross-sectional view of the first track portion 112A taken through the line shown in FIG. 4. Because the splice holes 155A-155D are threaded, the screws 158A-158D are adapted to force the splice 150 upwards against the flanges 154A, 154B of the track channels 152A, 152B to provide for vertical alignment of the first and second track portions 112A, 112B. When the screws 158A-158D are fully screwed through the respective splice holes 155A-155D, the conical base portions 162A-162D contact the bottom surfaces 153A, 153B of the track channels 152A, 152B. As the screws 158A-158D are tightened, the screws force the splice structure 150 against the flanges 154A, 154B of the track channels 152A, 152B, such that the splice structure provides for vertical alignment of the first and second track portions 112A, 112B. For example, the splice channels 152A, 152B may have a height $d_{HT\text{-}CHNL}$ of approximately 0.494 inch and the splice structure 150 may have a height $d_{HT\text{-}SPLICE}$ of approximately 0.374 inch, such that there is a distance $d_{GAP}$ (e.g., approximately 0.06 inch) between the splice structure and the bottom surfaces 153A, 153B of the splice channels when screws 158A-158D are fully tightened.

Since four screws 158A-158D are used, the splice structure 150 also provides for transverse alignment of the two track sections 112A, 112B. Specifically, the splice structure 150 is prevented from rotating about a yaw axis $A_{YAW}$ of the splice structure (i.e., a vertical axis extending perpendicularly to the splice structure through the center of the splice structure as shown in FIG. 3). Thus, the centerlines of the two track sections 112A, 112B are both aligned with the centerline of the splice structure 150 and the longitudinal axis $A_{LONG}$ of the track 112.

To allow for easier shipment from a manufacturer a customer, the first and second track portions 112A, 112B may be decoupled from each other and positioned parallel to each other before being packaged for shipment. The splice structure 150 may be located in one of the splice channels 152A, 152B of the two track sections 112A, 112B during shipment. For example, the splice structure 150 may be fully inserted into the splice channel 152A of the first track section 112A and the screws 158A, 158B may be installed through the third and fourth splice holes 155C, 155D and into the first and second track holes 156A, 156B. The other screws 158C, 158D may be installed in the other track holes 155A, 155B during shipment.

Figure 10:
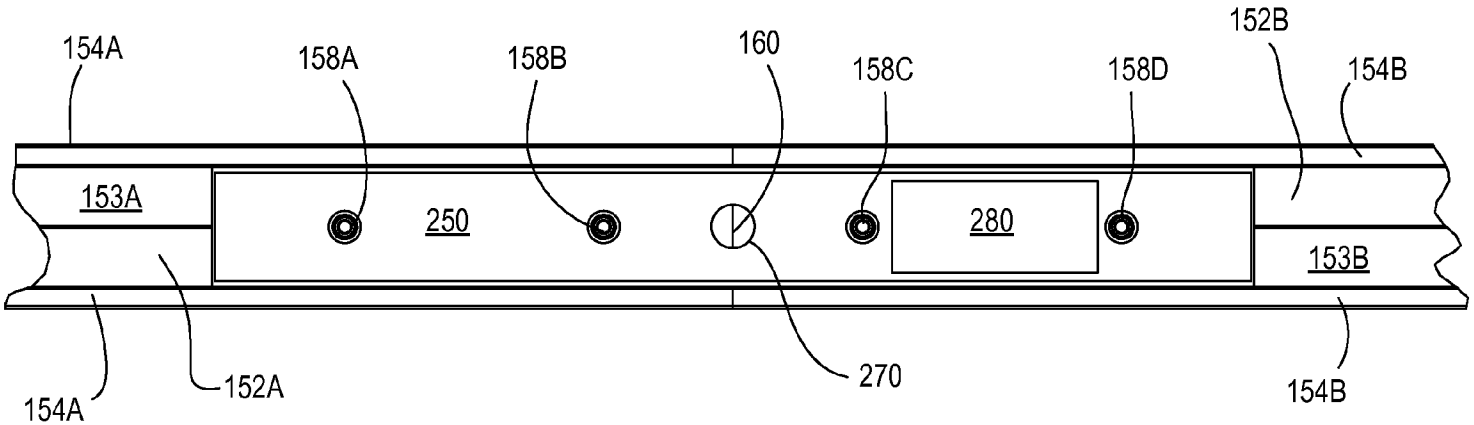
FIG. 10 is a top view of the first and second track portions coupled together via a splice structure according to a second embodiment of the present invention.

FIG. 10 is a top view of the two track portions 112A, 112B coupled together via a splice structure 250 according to a second embodiment of the present invention. The splice structure 250 includes a seam alignment feature, e.g., an opening 270 through which the seam 160 can be seen, to assist in positioning the splice structure 250 before the screws 158A-158D are installed. Specifically, the opening 270 may be centered about the seam 160, such that the splice holes 155A-155D are aligned with the corresponding track holes 156A-156D and the screws 158A-158D may be easily installed. In addition, the splice structure 150 comprises a label 280, which includes installation information, such as, for example, indicia regarding the order in which the screws 158A-158D should be installed and tightened.

Figure 11:
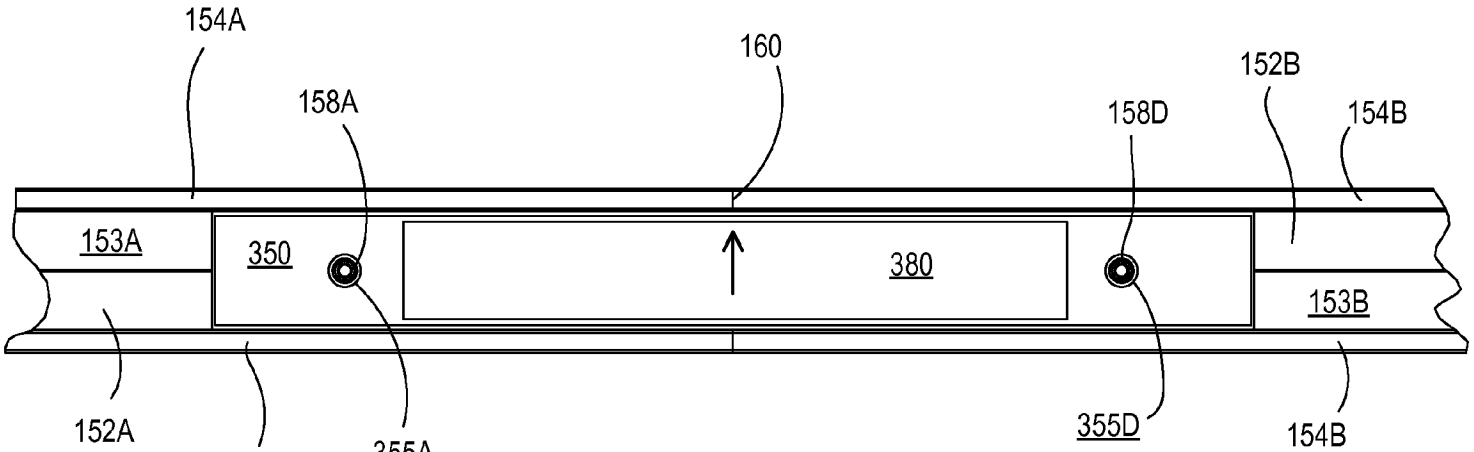
FIG. 11 is a top view of the first and second track portions coupled together via a splice structure according to a third embodiment of the present invention.

FIG. 11 is a top view of the two track portions 112, 112B coupled together via a splice structure 350 according to a third embodiment of the present invention. The splice structure 350 only includes two splice holes 355A, 355D for receipt of two screws 158A, 158D to couple the first and second track portions 112A, 112B together. The splice structure 350 comprises a label 380, which includes installation information, such as, for example, a seam alignment feature (e.g., an arrow) to assist in aligning the splice structure 350 with respect to the seam 160 between the two track portions 112A, 112B. Specifically, the arrow is aligned with the seam 160 before the screws 158A-158D are installed to allow for easy installation of the screws.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drapery system for allowing the movement of a suspended drapery fabric comprising:

an elongated track having two track portions and extending along a longitudinal axis of the track, each of the track portions having a splice channel and a circular track hole located in the splice channel;

an elongated rectangular splice structure having two circular splice holes extending through the splice structure, the splice structure adapted to be received within the splice channels of each of the track portions, such that the center of each splice hole is offset from the center of the respective track hole by a distance that is less than half of the radius of the track hole; and two screws adapted to be received through the splice holes and to extend into the track holes in a direction perpendicular to the splice structure;

wherein the distance between the centers of the two splice holes is less than the distance between the centers of the two track holes when the two track portions are aligned adjacent each other and the screws are not installed, each of the screws adapted to contact an edge of the respective track hole to provide a longitudinal force on the respective track portion, such that the track portions are forced together when the screws are installed in the splice holes and track holes.

2. The drapery system of claim 1, wherein each track portion comprises two circular track holes located in the respective splice channel and arranged along a centerline of the track portion parallel to the longitudinal axis, and the splice structure comprises four circular splice holes arranged along a centerline of the splice parallel to the longitudinal axis.

3. The drapery system of claim 2, further comprising:

two additional screws adapted to be received through the splice holes and to extend into the track holes;

wherein the two additional screws provide transverse alignment of the track portions to prevent rotation of the splice structure about a yaw axis of the splice when the screws are installed in the respective splice holes and track holes.

4. The drapery system of claim 3, wherein the distances between the splice holes of the splice structure are all equal.

5. The drapery system of claim 4, wherein the distance between the two track holes of each track portion is equal to the distance between the adjacent splice holes of the splice structure.

6. The drapery system of claim 3, wherein the splice structure comprises a label having installation information.

7. The drapery system of claim 6, wherein the installation information of the label comprises indicia regarding the order in which the screws should be installed and tightened.

8. The drapery system of claim 6, wherein the track portions meet at a seam, the installation information of the label comprising an arrow to be aligned with the seam before the screws are installed.

9. The drapery system of claim 3, wherein the track portions meet at a seam and the splice structure comprises a seam alignment feature to assist in positioning the splice in the splice channels before the screws are installed.

10. The drapery system of claim 9, wherein the seam alignment feature comprises an opening through which the seam can be seen.

11. The drapery system of claim 1, wherein each splice channel comprises an open side having two opposing flanges on each side of the open side, the splice structure captured by the flanges, such that the splice holes face the open side of the splice channel and are located between the flanges.

12. The drapery system of claim 11, wherein the screws and the splice holes of the splice structure are threaded.

13. The drapery system of claim 12, wherein the screws are adapted to contact bottom surfaces of the splice channels, such that the screws thus force the splice structure against the flanges to provide for vertical alignment of the track portions.

14. The drapery system of claim 11, wherein the splice structure is completely contained within a periphery of the track.

15. The drapery system of claim 1, wherein the screws comprise conical base portions for contacting edges of the track holes for forcing the first and second track portions together.

16. The drapery system of claim 15, wherein the conical base portions of the screws are arranged at an angle of approximately 45 degrees with respect to the longitudinal axis.

* * * * *